United States Patent [19]

Denz et al.

[11] Patent Number: 4,941,446

[45] Date of Patent: Jul. 17, 1990

[54] IGNITION AND FUEL INJECTION BACK-UP SYSTEM FOR EMERGENCY RUNNING OF INTERNAL COMBUSTION ENGINES

[75] Inventors: Helmut Denz, Stuttgart; Rudolf Moz, Möglingen; Winfried Uttenweiler, Tübingen, all of Fed. Rep. of Germany

[73] Assignee: Robert Bosch GmbH, Stuttgart, Fed. Rep. of Germany

[21] Appl. No.: 347,943

[22] PCT Filed: Sep. 2, 1987

[86] PCT No.: PCT/DE87/00398

§ 371 Date: Apr. 5, 1989

§ 102(e) Date: Apr. 5, 1989

[87] PCT Pub. No.: WO88/02817

PCT Pub. Date: Apr. 21, 1988

[30] Foreign Application Priority Data

Oct. 10, 1986 [DE] Fed. Rep. of Germany ..... 3634587

[51] Int. Cl.[5] ..... F02P 7/00

[52] U.S. Cl. ..... 123/414; 364/431.03

[58] Field of Search ..... 123/414, 612, 617; 364/431.03; 73/116; 324/208

[56] References Cited

U.S. PATENT DOCUMENTS

| | | | |
|---|---|---|---|
| 4,553,426 | 11/1985 | Capurka | 73/116 |
| 4,644,917 | 2/1987 | Yakuwa et al. | 123/414 |
| 4,656,993 | 4/1987 | Yuzawa et al. | 123/414 |
| 4,700,305 | 10/1987 | Lotterbach et al. | 364/431.03 |
| 4,726,338 | 2/1988 | Deekar et al. | 123/414 |
| 4,760,827 | 8/1988 | Schreiber et al. | 123/414 |
| 4,766,865 | 8/1988 | Härtel | 123/414 |
| 4,783,627 | 11/1988 | Pagel et al. | 324/208 |
| 4,797,827 | 1/1989 | Cockerham | 364/431.03 |

*Primary Examiner*—Raymond Nelli

*Attorney, Agent, or Firm*—Michael J. Striker

[57] ABSTRACT

An ignition and injection system for internal combustion engines is suggested in which a phase sensor which includes a sensor drum driven synchronously with the ignition distributor, particularly a Hall sensor drum formed with a plurality of cut-out portions, one of which is wider than the cut-out portions, and indicates the beginning of an ignition or injection cycle in emergency running. The cut-out portions produce correspondingly long timing pulses, at the beginning of which the ignition coil is charged until the trailing edge occurs and the ignition is effected. The trailing edge of the timing pulses can occur e.g. 10° before the top dead center of the respective cylinder.

9 Claims, 3 Drawing Sheets

IGNITION AND FUEL INJECTION BACK-UP SYSTEM FOR EMERGENCY RUNNING OF INTERNAL COMBUSTION ENGINES

BACKGROUND OF THE INVENTION

The invention is directed to an ignition and fuel injection back-up system for emergency running or starting internal combustion engines in which a Hall sensor drum is driven synchronously with a cam shaft of the engine and delivers a timing pulse to a computer at the beginning of an ignition cycle, the computer controls the ignition, possibly while taking into account additional engine data, and the Hall sensor drum has a cut out portion for every cylinder or every second cylinder, which cut out portions cause a corresponding quantity of timing pulses whose trailing edges occur at a uniform rotational angle before the top dead center of the respective cylinder.

In ignition systems with cylinder recognition, it is known to utilize Hall sensor drums in the ignition distributor, which sensor drum comprises a cut out portion which produces one timing pulse per 720° crankshaft revolution. During the timing pulse, a reference mark is derived e.g. from the toothed rim or from the flywheel of the crankshaft. This reference mark occurs once per revolution of the crankshaft, so that only every second reference mark occurs in the time period of a timing signal. Accordingly, the timing signal and the reference mark together designate the beginning of an ignition cycle from which an exact determination of the optimal ignition times for respective cylinders of the engine can be effected in a microprocesor while taking into account additional engine data, particularly while taking into account the speed or rate of rotation. In the event of the failure of the transmitter for the reference mark or the speed, respectively, in such a system, the engine can no longer continue to be operated.

SUMMARY OF THE INVENTION

In contrast, an ignition and injection system according to the invention is characterized in that one of the cut out portions of the sensor drum is constructed so as to be wider than the others and causes a wider timing pulse relative to the rest of the timing pulses, and in that the beginning of an ignition cycle is detected when an additional reference mark derived from a toothed rim or from the flywheel of the crankshaft occurs during the wider timing pulse. The invention has the advantage that the additional cut out portion in the sensor drum which are assigned to the individual top dead centers of the cylinders produce a timing signal in each instance by means of a Hall sensor, from which a defined fixed ignition angle can be determined. An enlarged cut out portion or phase window, which produces a wider timing pulse, indicates the beginning of an ignition cycle when a reference mark occurs in this phase window. The other phase windows must be sufficiently narrow so that the second reference mark does not occur therein in the course of two revolutions, so that an unambiguous cylinder recognition is ensured. In practice, for emergency running and possibly starting, the timing pulses represent the closing time for the ignition coil and the injection pulses, respectively, wherein the ignition spark is produced during the occurrence of the trailing edge of the timing pulses. This has the advantage not only that an emergency running ignition angle function is realized in a simple manner in the event of disturbance, but also that an earlier commencement of ignition, and accordingly shorter starting times, are achieved also when starting the engine.

The ignition angle can lie e.g. 10° before the top dead center. Moreover, the speed can be determined from the time interval between the trailing edges, and a closing time which is adapted to the speed and during which the ignition coil is charged can be determined by the computer, as can the injection time. An optimization of the emergency running ignition angle function is achieved by means of this step. The emergency running function can also be improved in that the speed is determined from the fixed trailing edges, a delay time for the commencement of closing and a delay time for the ignition being determined from the latter. A more accurate closing time and a more variable ignition angle can accordingly be realized for stationary operation, so that overheating of the final stage can be prevented.

In normal operation which is free of disturbance, two reference marks occur per every ignition cycle, wherein the reference mark occurring in the middle of an ingition cycle does not coincide with a timing pulse, so that this reference mark can also not be mistakenly viewed as the starting mark of an ignition cycle.

The measures, according to the invention, are not limited to ignition systems, but are also applicable to injection systems.

DRAWING

The invention is explained in more detail in the following by means of the drawing.

FIG. 1*a* shows a top view of a Hall sensor drum;

FIG. 1*b* shows a side view of the Hall sensor drum shown in FIG. 1*a;*

DESCRIPTION OF THE PREFERRED EMBODIMENTS

Figure 1A:
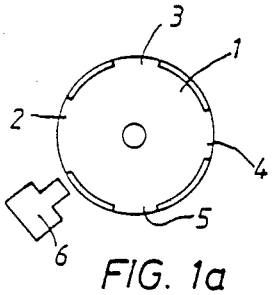
Figure 1B:
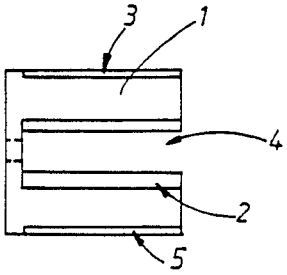

The Hall sensor drum 1 shown in FIGS. 1*a* and 1*b* comprises four cut out portions 2, 3, 4, 5, the cut out portion 2 being enlarged relative to the rest of the cut out portions 3 to 5. The Hall sensor drum 1 is built into the ignition distributor or on the camshaft and rotates synchronously with the distributor rotor. A Hall sensor or probe 6, whose sensor signals are fed to an electronic engine controlling means 7 (FIG. 2), is located at a slight distance from the Hall sensor drum 1.

Figure 2:
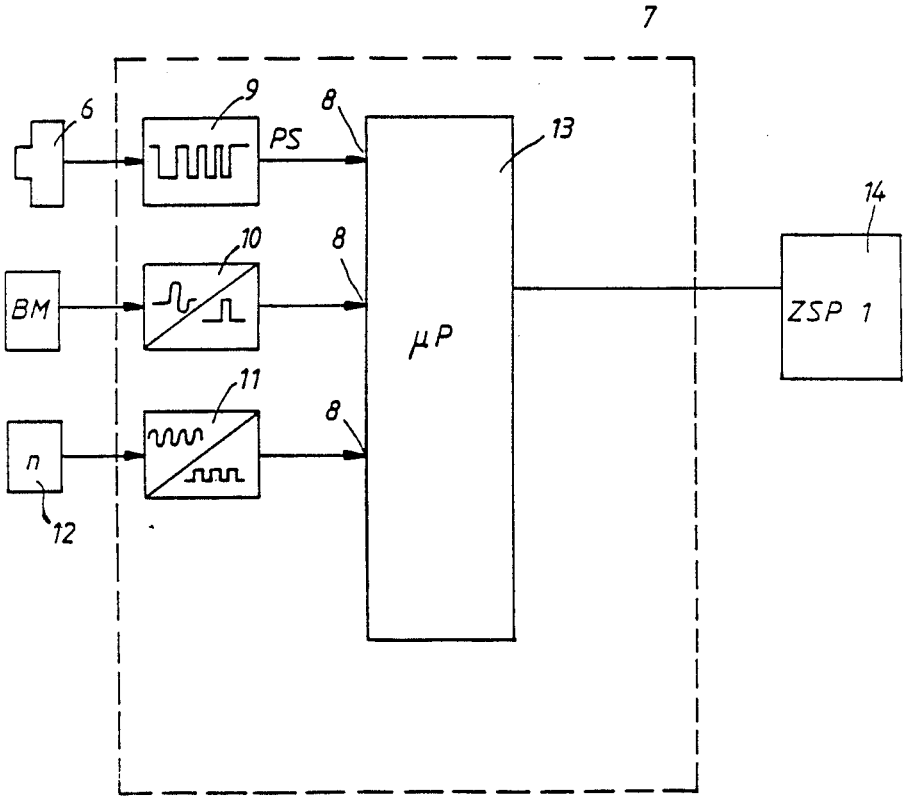
FIG. 2 shows a block circuit diagram of the ignition back-up system for a 4-cylinder engine.

The engine controlling means 7 in FIG. 2 produces the timing signal PS from the sensor signal, the timing signal PS being supplied to a computer port 8. A signal converter 9 which converts the signal received from the Hall sensor 6 into square-wave timing pulses, is provided for preparing the timing signal PS. Additional signal converters 10, 11 are provided which produce square-wave reference signals BM1 and BM2 from the reference mark BM derived from the toothed rim of the flywheel on the crankshaft of the engine, and a square-wave speed signal derived from the speed signal n emitted by the speed sensor 12.

In the event of a failure of the reference mark BM or the speed signal n due to a disturbance, an emergency running ignition function can be realized solely on the basis of the sensor signal sent from the Hall sensor 6.

Figure 3:
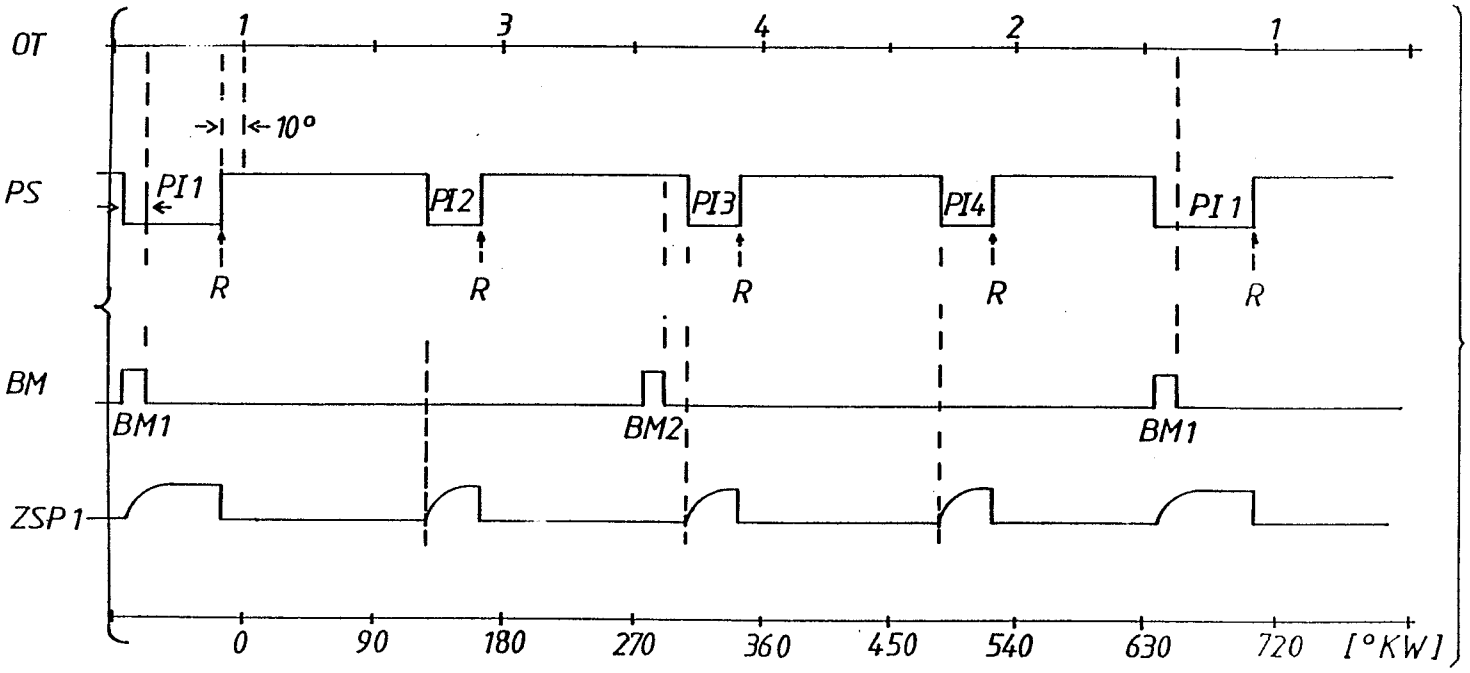
FIG. 3 shows phase diagrams of a 4-cylinder engine.

In FIG. 3, the top dead center OT of cylinders 1 to 4 drawn in the top line is correlated to the degrees of rotation of the crankshaft KW drawn in the bottom line. Indicated below the top line is the timing signal PS which contains a wider timing pulse PI1 at the commencement of an ignition cycle. The additional timing pulses PI2 to PI4 are shorter. The trailing edges R of all timing pulses PI1 to PI4 occur at 10° of the crankshaft revolution before the top dead center OT of the respective cylinders.

The assignment of the reference mark BM with respect to time, which reference mark BM is already converted as square-wave reference signal BM1 or BM2, is ensured in such a way that the middle reference pulse BM2 does not coincide with the timing pulses PI1 to PI4. Only the reference pulse BM1 coincides with the wider timing pulse PI1, so that the commencement of the ignition cycle is determined in the synchronized, disturbance-free normal operation.

In the event of a failure of the reference mark signal BM due to a disturbance, an emergency running ignition function can be maintained solely on the basis of the timing signal PS. In this case, the ignition coil ZSP1 of the ignition final stage 14 (FIG. 2) is charged at the commencement of every timing pulse of the timing signal PS and the ignition is triggered in each instance at 10° before the top dead center OT when the trailing edge R occurs. The timing signal PS accordingly defines a fixed emergency running ignition angle which enables an emergency operation in the absence of the reference mark BM or speed signal n.

Figure 4:
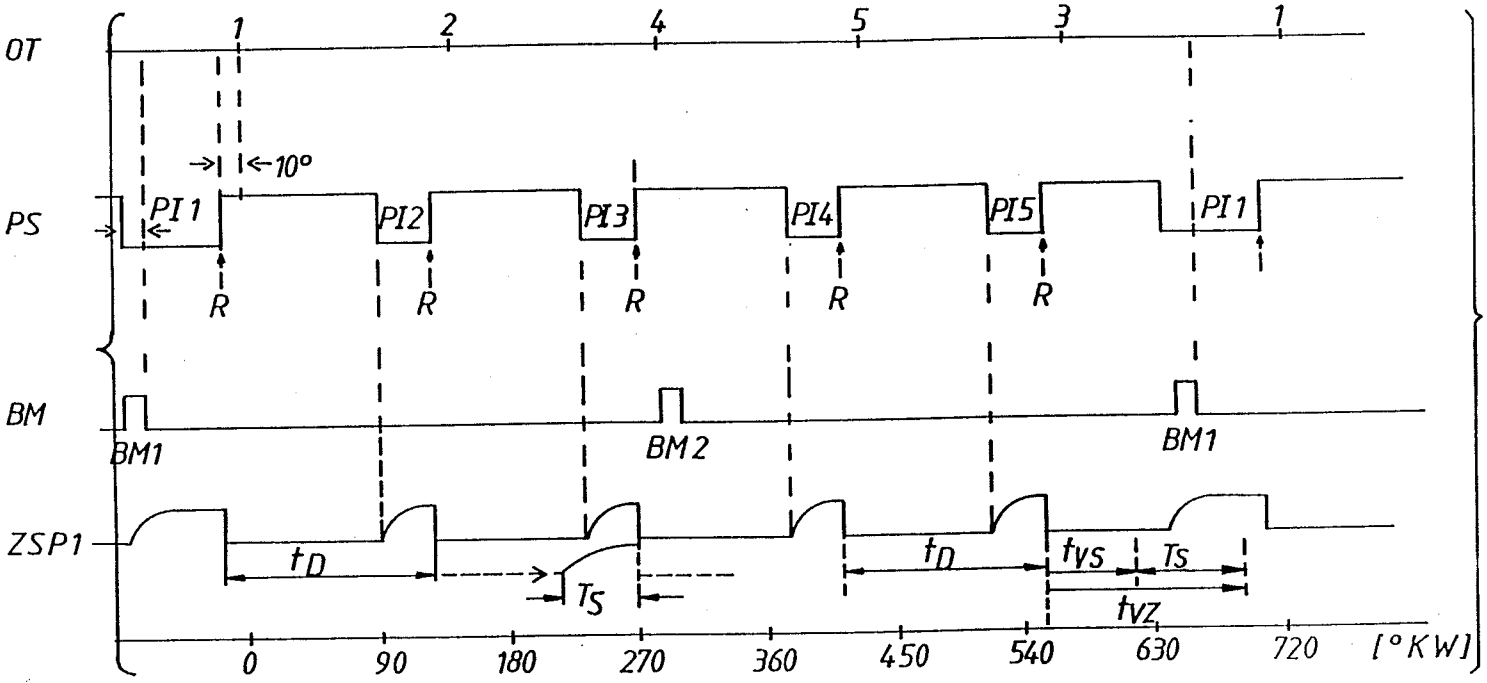
FIG. 4 shows phase diagrams of a 5-cylinder engine.

FIG. 4 shows the corresponding diagram for a 5-cylinder engine in which a timing pulse PI1 to PI5 is assigned to every cylinder 1 to 5. However, in this case, in the current curve of the ignition coil ZSP1 there is indicated the additional possibility that the time $t_D$ between two consecutive trailing edges R is utilized for determining the speed. A corrected time for the charging of the ignition coil can then be calculated from the determined speed. The case in which the closing time $T_S$ and ignition time are calculated proceeding from the preceding phase edge is also shown.

The speed can be calculated from the fixed trailing edges R, and a delay time $t_{VS}$ for the commencement of a closing time $T_S$ during which an ignition coil is charged, and a delay time $t_{VZ}$ for the ignition time can be determined from the latter, so that a more accurate closing time $T_S$ and a more variable ignition angle can be realized for the stationary operation.

We claim:

1. Ignition back-up system for emergency running or starting internal combustion engines including at least one ignition coil, comprising a computer for controlling the ignition time of the coil, a sensor cooperating with a sensor drum driven synchronously with a cam shaft of the engine, the sensor drum having cut out portions for every cylinder of the engine to generate by means of the sensor cylinder-related timing pulses which are delivered to the computer, the trailing edge of the respective timing pulses occurring at a uniform rotational angle of the crankshaft of the engine before the top dead center of the corresponding cylinders, one of the cut out portions being wider than the others to generate a wider timing pulse relative to the rest of the timing pulses, means for generating and delivering to the computer a reference pulse once per revolution of the crankshaft, the reference pulse coinciding with the wider timing pulse but being spaced apart from the rest of the timing pulses, and once per revolution of the cam shaft the computer detecting the beginning of an ignition cycle when the reference pulse occurs during the wider timing pulse or, in the absence of the reference pulse, during the wider timing pulse.

2. Ignition system according to claim 1, characterized in that the ignition coil is charged at the start of the corresponding timing pulses and the ignition is triggered during their trailing edge.

3. Ignition system according to claim 1, characterized in that the trailing edge occurs in each instance at approximately 10° before the top dead center of the respective cylinder.

4. Ignition system according to claim 1, characterized in that the engine speed is determined from the time interval between the occurring trailing edges of the timing pulses, and a speed adapted time (TS) during which the ignition coil is charged as determined by the computer.

5. Ignition system according to claim 1, characterized in that the trailing edges of the timing pulses are utilized for determining the ignition time only when starting the engine and/or during occurring disturbances.

6. Ignition system according to claim 1, characterized in that the diaphragm is utilized for producing an emergency ignition in the event of a defect in means for generating the reference pulse.

7. Ignition system according to claim 1, characterized in that said sensor is a Hall sensor.

8. Ignition system according to claim 1, characterized in that the timing pulses and the reference pulses are utilized for controlling a fuel injection system of the engine.

9. Ignition system according to claim 1, wherein the cut out portions of the diaphragm are assigned to every second cylinder of the engine.

* * * * *